US009905387B2

(12) United States Patent
Davis et al.

(10) Patent No.: US 9,905,387 B2
(45) Date of Patent: Feb. 27, 2018

(54) CIRCUIT BREAKER INCLUDING END COVERS

(71) Applicant: General Electric Company, Schenectady, NY (US)

(72) Inventors: Alisha Marie Davis, East Granby, CT (US); Dhirendra Tiwari, Farmington, CT (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 15/082,585

(22) Filed: Mar. 28, 2016

(65) Prior Publication Data

US 2017/0278660 A1 Sep. 28, 2017

(51) Int. Cl.

| | |
|---|---|
| ***H01H 1/64*** | (2006.01) |
| ***H01H 1/66*** | (2006.01) |
| ***H01H 9/02*** | (2006.01) |
| ***H01H 9/06*** | (2006.01) |
| ***H01H 13/00*** | (2006.01) |
| ***H01H 19/04*** | (2006.01) |
| ***H01H 19/08*** | (2006.01) |
| ***H01H 21/00*** | (2006.01) |
| ***H01H 71/02*** | (2006.01) |
| ***H01H 69/00*** | (2006.01) |

(52) U.S. Cl.

CPC ..... *H01H 71/025* (2013.01); *H01H 69/00* (2013.01)

(58) Field of Classification Search

CPC ..... H01H 13/00; H01H 13/50; H01H 19/04; H01H 19/08; H01H 21/00; H01H 71/00; H01H 71/02; H01H 71/025; H01H 71/10; H01H 2009/20; H01H 2223/00; H01H 2071/7481; H01H 1/64; H01H 1/66; H01H 9/02; H01H 9/06; H01H 69/00

USPC ..... 200/293, 43.01, 43.08, 43.11, 43.22, 200/19.22, 19.3

See application file for complete search history.

(56) References Cited

U.S. PATENT DOCUMENTS

| | | | | |
|---|---|---|---|---|
| 4,019,005 | A * | 4/1977 | Michetti | H01H 9/342 200/306 |
| 4,945,327 | A | 7/1990 | Doughty et al. | |
| 4,975,667 | A * | 12/1990 | Morgan | H01H 71/0257 200/293 |
| 5,089,795 | A | 2/1992 | Morgan et al. | |
| 5,150,091 | A | 9/1992 | Hart et al. | |
| 5,258,733 | A | 11/1993 | Link et al. | |

(Continued)

OTHER PUBLICATIONS

Smith A.J III, "Short circuit ratings, labels and fault withstandability of molded-case and insulated-case circuit breakers and combination motor starters", Industry Applications Society Annual Meeting, 1989, vol. 2, pp. 1830-1838, Oct. 1-5, 1989, San Diego, CA, USA.

*Primary Examiner* — Anthony R. Jimenez
(74) *Attorney, Agent, or Firm* — GE Global Patent Operation; Stephen G. Midgley

(57) ABSTRACT

A circuit breaker includes an electrically insulative case including a first end and a second end opposite the first end. The circuit breaker further includes an end cover selectively installable on both the first and second ends of the electrically insulative case. The end cover includes a wall defining at least one opening for receiving a removable shield, a first end connectable to the electrically insulative case first end, and a second end connectable to the electrically insulative case second end.

18 Claims, 10 Drawing Sheets

(56) References Cited

U.S. PATENT DOCUMENTS

| | | | | |
|---|---|---|---|---|
| 5,304,761 | A * | 4/1994 | Rosen | H01H 9/0264 200/304 |
| 6,307,456 | B1 | 10/2001 | Caggiano et al. | |
| 6,930,577 | B2 | 8/2005 | Subramanian et al. | |
| 8,853,576 | B2 | 10/2014 | Sisley et al. | |

* cited by examiner

CIRCUIT BREAKER INCLUDING END COVERS

BACKGROUND

The field of the disclosure relates generally to circuit breakers and, more particularly, to circuit breakers including end covers.

Circuit breakers are often used to protect, in a residential, industrial, utility, or commercial environment, against overcurrent conditions, ground fault conditions, or other system anomalies that are undesirable and require the circuit breaker to interrupt the flow of current through the circuit breaker. At least some known circuit breakers include lugs for coupling to a circuit. For example, in some circuit breakers, a load lug is positioned on an end of the circuit breaker and a line lug is positioned on an opposite end of the circuit breaker. Current flows through the circuit breaker from the line lug to the load lug. When the circuit breaker has a reverse feed, the current flows through the circuit breaker from the load lug to the line lug. Sometimes, operation of the circuit breaker generates arc gases and particulates which cause deterioration of components of the circuit breaker. Accordingly, some circuit breakers include shielding to inhibit the arc gases and particulates from contacting components such as the line lugs.

At least some known circuit breakers include an electrically insulative case and end covers coupled to the ends of the electrically insulative case. Typically, a different end cover is required for coupling to each end of the electrically insulative case. For example, the end cover adjacent the line lugs is differentiated from the end cover adjacent the load lug to accommodate shielding that inhibits arc gas and particulates from contacting the line lugs. Moreover, each end cover is assembled from multiple unique parts which increase the number of parts required to assemble the circuit breakers. Also, some circuit breakers are assembled without lugs on at least one end. Accordingly, a different end cover, e.g., a finishing cover, is coupled to the electrically insulative case adjacent the end without lugs. As a result, the cost to manufacture and assemble circuit breakers including end covers is increased.

BRIEF DESCRIPTION

In one aspect, a circuit breaker is provided. The circuit breaker includes an electrically insulative case including a first end and a second end opposite the first end. The circuit breaker further includes an end cover selectively installable on both the first and second ends of the electrically insulative case. The end cover includes a wall defining at least one opening for receiving a removable shield, a first end connectable to the electrically insulative case first end, and a second end connectable to the electrically insulative case second end.

In another aspect, an end cover for a circuit breaker having an electrically insulative case is provided. The end cover is selectively installable on both a first end and a second end of the electrically insulative case. The end cover includes a first end and a second end opposite the first end. The first end of the end cover is connectable to the first end of the electrically insulative case and the second end of the end cover is connectable to the second end of the electrically insulative case. The end cover further includes a wall defining an interior space sized to receive at least one lug extending from the electrically insulative case.

In yet another aspect, a method of manufacturing a circuit breaker is provided. The method includes positioning a lug adjacent to an end of an electrically insulative case and coupling an end cover to the end of the electrically insulative case adjacent the lug. The end cover includes a wall defining at least one opening sized to receive at least one removable shield.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems including one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "substantially," and "approximately," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Exemplary embodiments of circuit breakers and methods of manufacturing circuit breakers are described herein. The circuit breakers generally include an electrically insulative case and end covers coupled to line and load ends of the case. The end covers are interchangeable to reduce the number of unique parts required to manufacture and assemble circuit breakers. A removable shield couples to the end cover coupled to the line end to shield line lugs from arc gas and particulates during operation of the circuit breakers. A plug couples to the end cover coupled to the load end to close an opening for receiving the removable shield. In some embodiments, a finishing end cover is coupled to an end of the case when lugs are omitted from the respective end of the circuit breaker.

Figure 1:
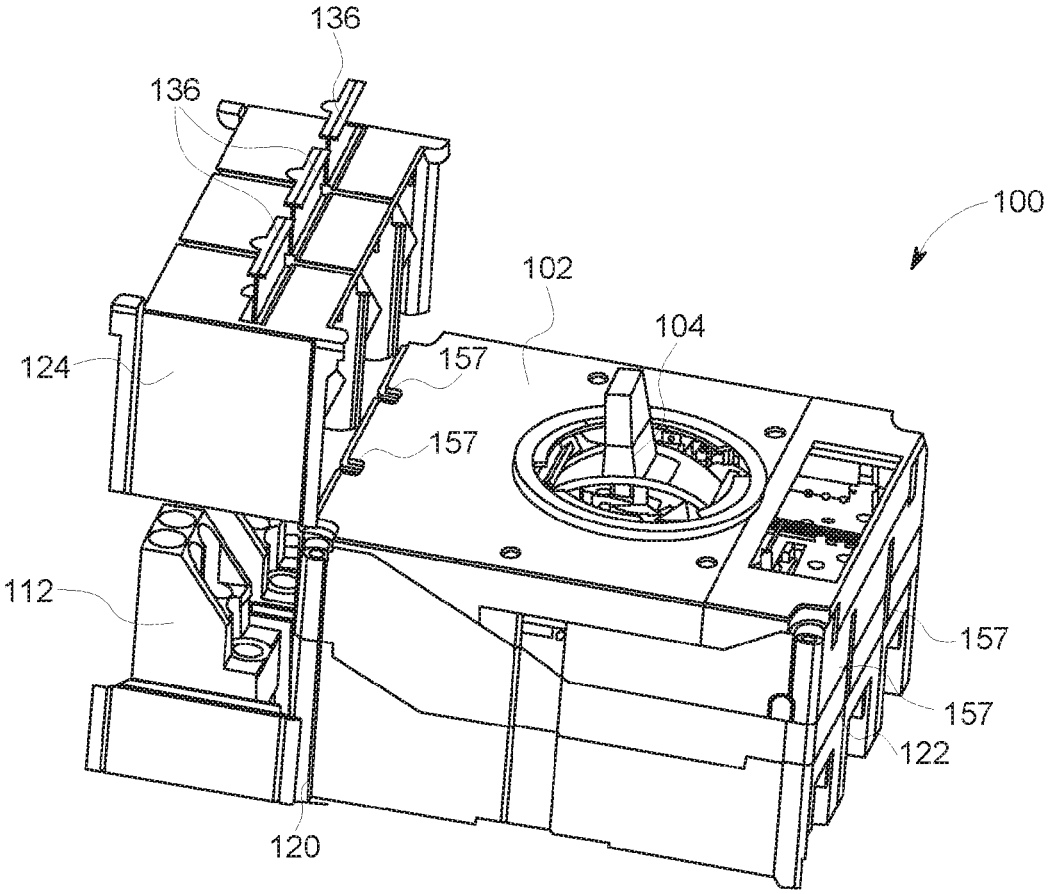
FIG. 1 is a perspective view of a circuit breaker.

FIG. 1 is a perspective view of a circuit breaker 100. Circuit breaker 100 includes a case 102 and an operating mechanism 104. In alternative embodiments, circuit breaker 100 includes any components that enable circuit breaker 100 to operate as described herein. For example, in some embodiments, circuit breaker 100 includes load straps, movable contacts, and/or trip mechanisms. In the exemplary embodiment, circuit breaker 100 is coupled to a circuit such that circuit breaker 100 controls flow of electric current through the circuit. In particular, when operating mechanism 104 of circuit breaker 100 is triggered, i.e., circuit breaker 100 is tripped, the flow of electric current through the circuit coupled to circuit breaker 100 is stopped.

Figure 2:
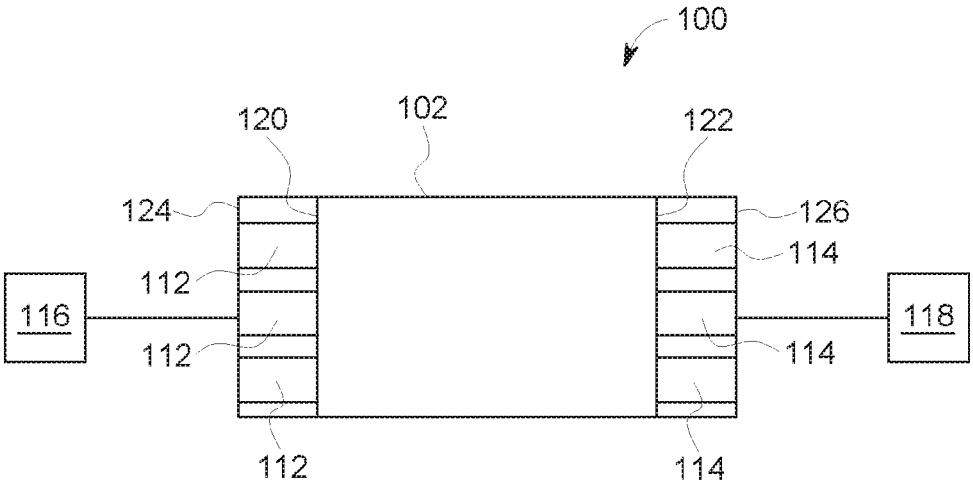
FIG. 2 is a schematic view of the circuit breaker shown in FIG. 1.

FIG. 2 is a schematic view of circuit breaker 100. Circuit breaker 100 further includes line lugs 112 and load lugs 114. A power source 116 is connected to line lugs 112 and a load 118 is connected to load lugs 114 such that current flows through circuit breaker 100 from line lugs 112 to load lugs 114. In alternative embodiments, power source 116 is connected to load lugs 114 and load 118 is connected to line lugs 112 such that current flows through circuit breaker 100 from load lugs 114 to line lugs 112. In the exemplary embodiment, circuit breaker 100 includes three line lugs 112 and three load lugs 114. In alternative embodiments, circuit breaker 100 includes any line lugs 112 and load lugs 114 that enable circuit breaker 100 to operate as described herein. For example, in some embodiments, line lugs 112 and/or load lugs 114 are omitted.

In reference to FIGS. 1 and 2, case 102 is configured to electrically insulate circuit breaker 100 such that electrical current is inhibited from passing through case 102 to the surrounding environment. Case 102 includes a first end 120 and a second end 122 opposite first end 120. First end 120 and second end 122 are at least partially open to provide access to circuit breaker 100. Line lug 112 is adjacent first end 120 such that power source 116 is coupled to circuit breaker 100 adjacent first end 120. Accordingly, first end 120 forms a line end of circuit breaker 100. Load lug 114 is adjacent second end 122 such that load 118 is coupled to circuit breaker 100 adjacent second end 122. Accordingly, second end 122 forms a load end of circuit breaker 100. In alternative embodiments, case 102 has any configuration that enables circuit breaker 100 to operate as described herein.

In the exemplary embodiment, circuit breaker 100 further includes first end cover 124 and second end cover 126. First end cover 124 is coupled to first end 120 adjacent line lugs 112. Second end cover 126 is coupled to second end 122 adjacent load lugs 114. First end cover 124 and second end cover 126 receive line lugs 112 and load lugs 114 and are configured to electrically insulate line lugs 112 and load lugs 114 and to inhibit objects from contacting line lugs 112 and load lugs 114. Moreover, first end cover 124 and second end cover 126 protect line lugs 112 and load lugs 114 from the environment to inhibit deterioration of line lugs 112 and load lugs 114. First end cover 124 and second end cover 126 are interchangeable. In other words, first end cover 124 is configured to couple to second end 122 and second end cover 126 is configured to couple to first end 120. In alternative embodiments, first end cover 124 and second end cover 126 have any configurations that enable circuit breaker 100 to operate as described herein.

Figure 3:
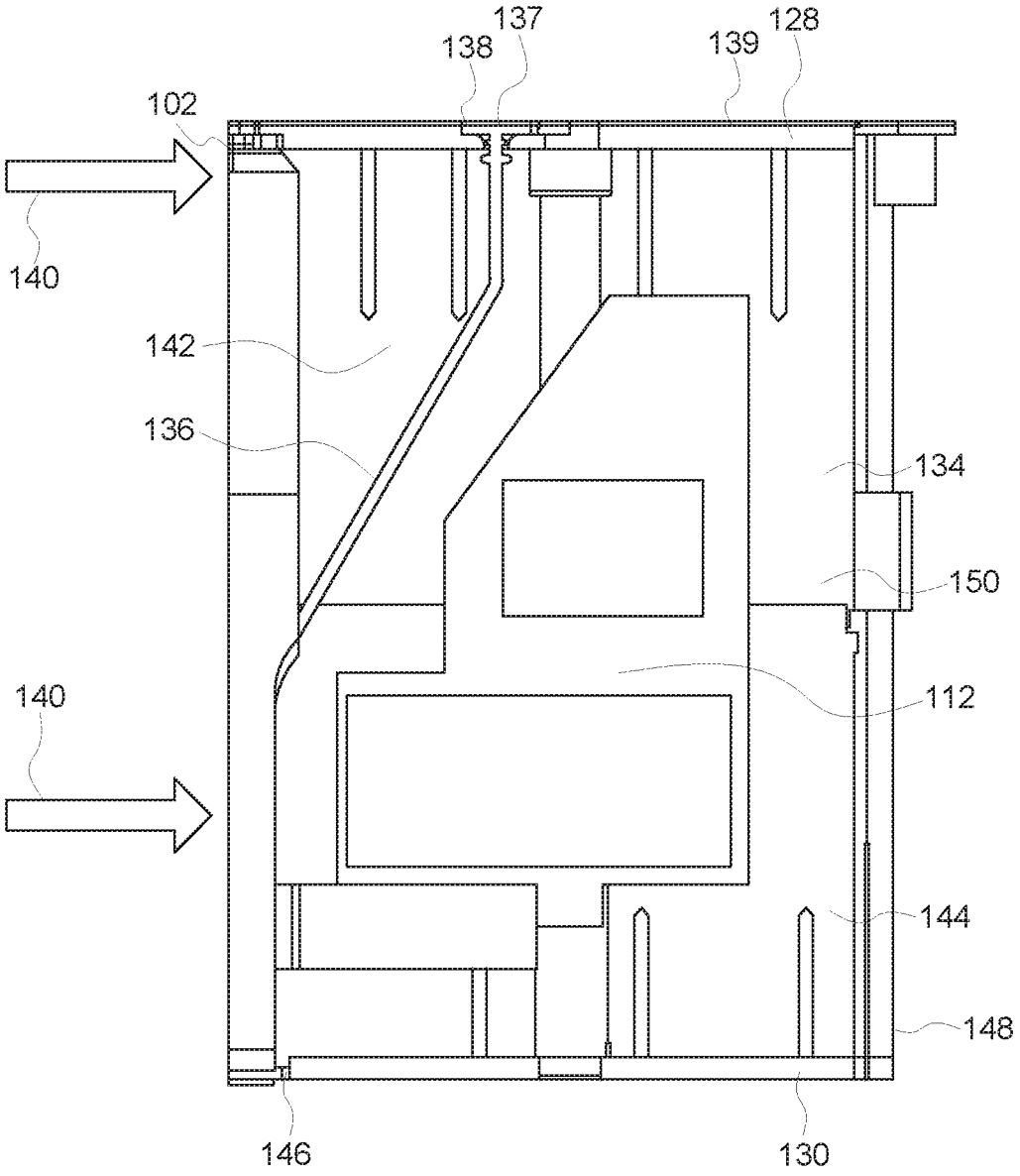
FIG. 3 is a sectional view of a portion of the circuit breaker shown in FIG. 1.
Figure 4:
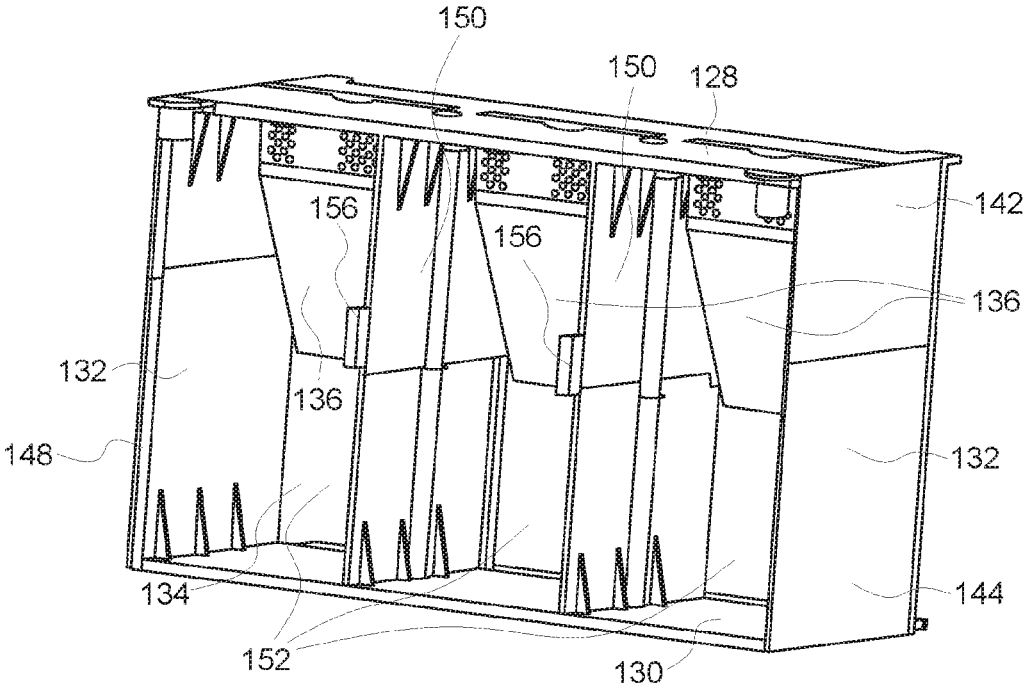
FIG. 4 is a perspective front view of an end cover of the circuit breaker shown in FIG. 1.
Figure 5:
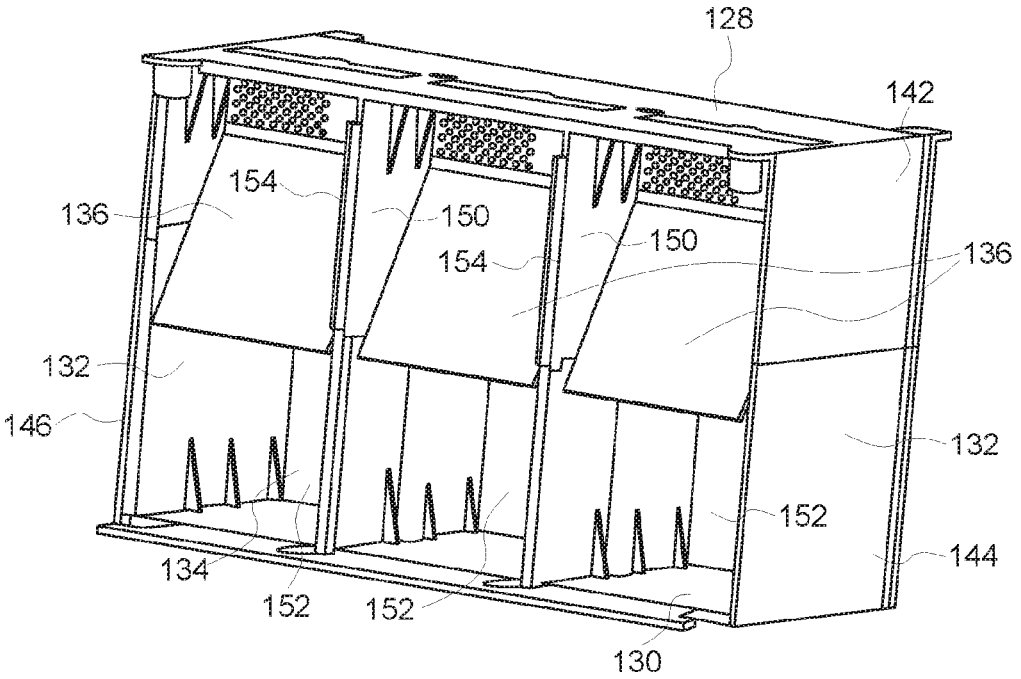
FIG. 5 is a perspective rear view of the end cover shown in FIG. 4.
Figure 6:
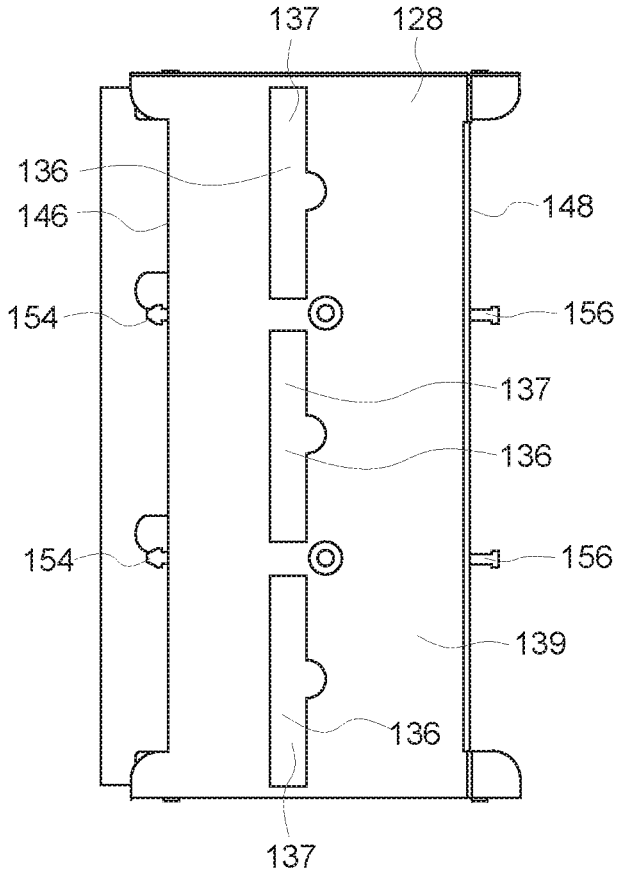
FIG. 6 is a top view of the end cover shown in FIG. 4.

FIG. 3 is a sectional view of a portion of circuit breaker 100 including first end cover 124. FIG. 4 is a perspective front view of first end cover 124. FIG. 5 is a perspective rear view of first end cover 124. FIG. 6 is a top view of first end cover 124. First end cover 124 includes a top wall 128, a bottom wall 130, and a pair of sidewalls 132 extending between top wall 128 and bottom wall 130. Together, top wall 128, bottom wall 130, and sidewalls 132 define an interior space 134 for receiving line lugs 112. A removable shield 136 is coupled to first end cover 124 and extends in interior space 134 adjacent line lug 112. Top wall 128 defines an opening 138 for receiving a portion of removable shield 136. In alternative embodiments, first end cover 124 has any walls that enable first end cover 124 to function as described herein.

In the exemplary embodiment, removable shield 136 inhibits arc gas 140 and particulates from contacting line lugs 112 during operation of circuit breaker 100. As will be described below, removable shield 136 engages top wall 128. To install removable shield 136, removable shield 136 is inserted in opening 138 until a snap fit is achieved. When removable shield 136 is fully inserted in opening 138, a top surface 137 of removable shield 136 is substantially flush with a top surface 139 of top wall 128. In alternative embodiments, removable shield 136 is coupled to first end cover 124 in any manner that enables circuit breaker 100 to operate as described herein.

Also, in the exemplary embodiment, first end cover 124 further includes an upper portion 142 and a lower portion 144. Upper portion 142 includes top wall 128 and portions of side walls 132. Lower portion 144 includes bottom wall 130 and portions of side walls 132. Upper portion 142 and lower portion 144 are removably coupled together and at least partially define interior space 134. A plurality of partitions 150 extend between top wall 128 and bottom wall 130 and divide interior space 134 into a plurality of slots 152 for receiving line lugs 112. Each slot 152 corresponds with one opening 138 in top wall 128. Accordingly, removable shields 136 extend in slots 152 adjacent line lugs 112 when coupled to upper portion 142. In the illustrated embodiment, interior space is divided into three slots 152. In alternative embodiments, interior space 134 is divided into any slots 152 that enable circuit breaker 100 to operate as described herein.

In reference to FIGS. 1, 4, and 5, first end cover 124 is reversible such that a first end 146 couples to first end 120 of case 102 and an opposite second end 148 couples to second end 122 of case 102. In particular, first end 146 of first end cover 124 includes a plurality of first engagement components 154 to engage first end 120 of case 102. Second end 148 of first end cover 124 includes a plurality of second engagement components 156 to engage second end 122 of case 102. Moreover, first engagement components 154 and second engagement components 156 are differentiated to inhibit coupling first end cover 124 to case 102 in the incorrect orientation. For example, first engagement components 154 are configured to engage first end 120 but not second end 122.

First engagement components 154 and second engagement components 156 each include a keyed projection having a shape that corresponds to a channel 157 on first end 120 or second end 122. To couple first end cover 124 to case 102, first engagement components 154 or second engagement components 156 are inserted at partially in the corresponding channels 157 on first end 120 or second end 122. Upper portion 142 is removably coupled to lower portion 144 to secure first engagement component 154 or second engagement component 156 in the corresponding channel. First engagement components 154 and second engagement components 156 are omitted on lower portion 144 such that lower portion 144 couples to case 102 in either direction. In alternative embodiments, first end cover 124 has any engagement components 154, 156 that enable circuit breaker 100 to operate as described herein. In some embodiments, at least one of first engagement component 154 and second engagement component 156 is adjustable to facilitate coupling first end cover 12 to different circuit breakers 100. For example, in some embodiments, first engagement components 154 include knockouts configured to facilitate coupling first end cover 124 to draw-out units.

Figure 7:
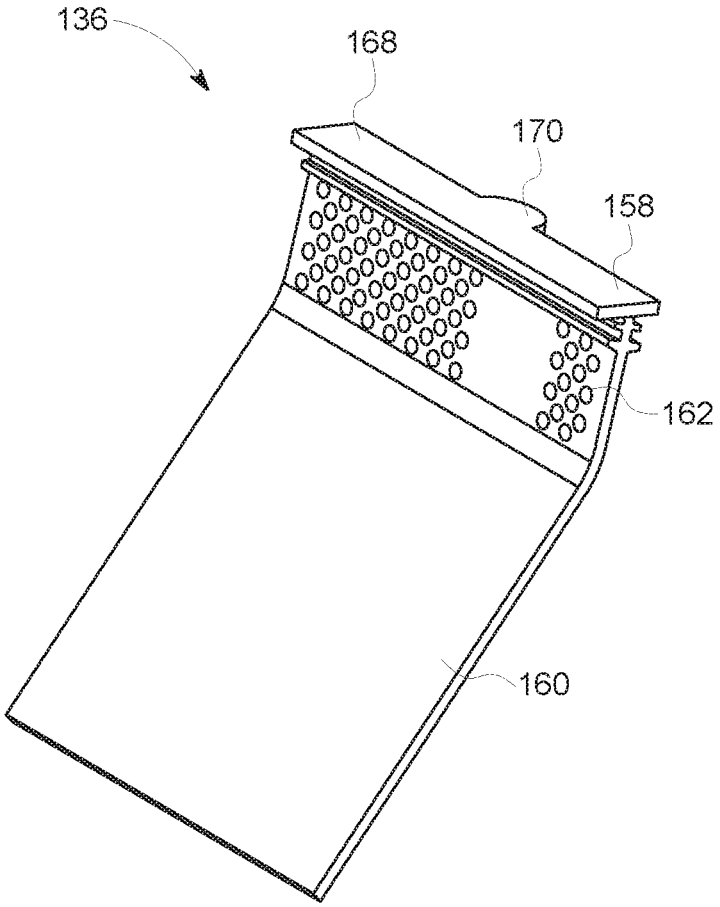
FIG. 7 is a perspective view of a removable shield of the end cover shown in FIG. 4.
Figure 8:
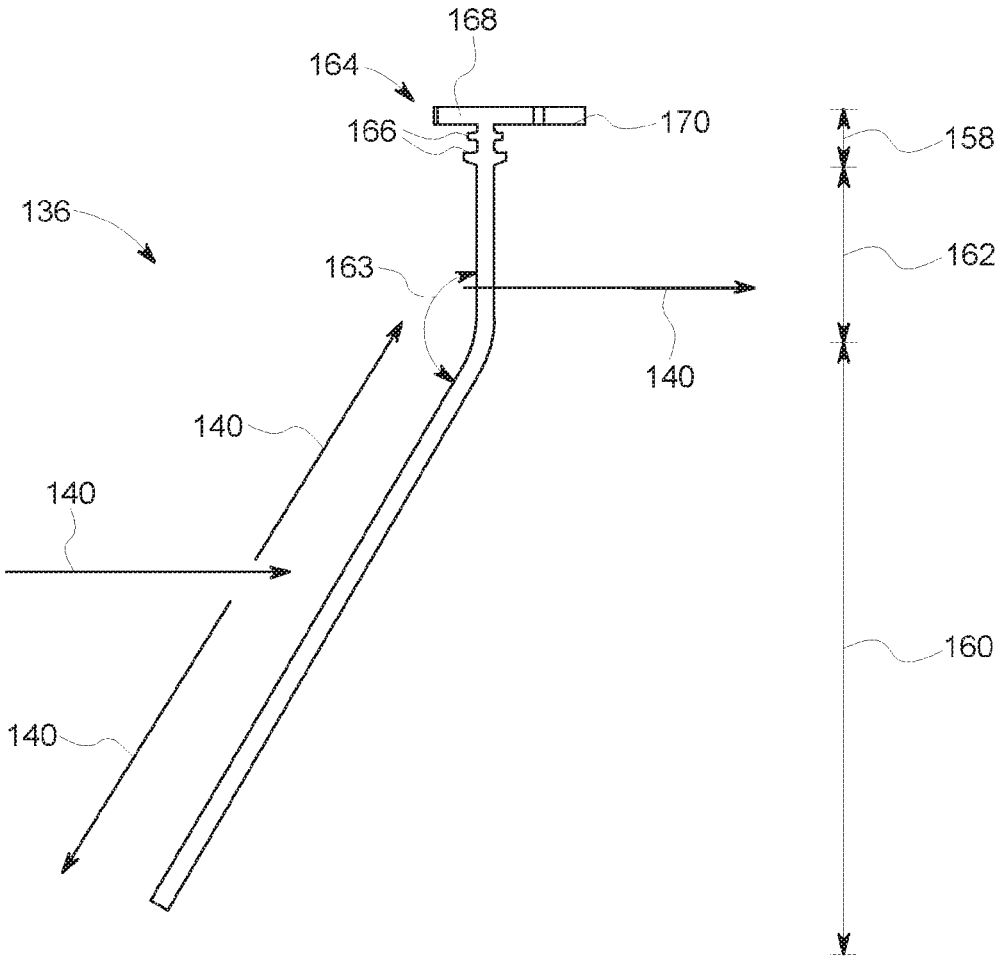
FIG. 8 is a side view of the removable shield shown in FIG. 7.
Figure 9:
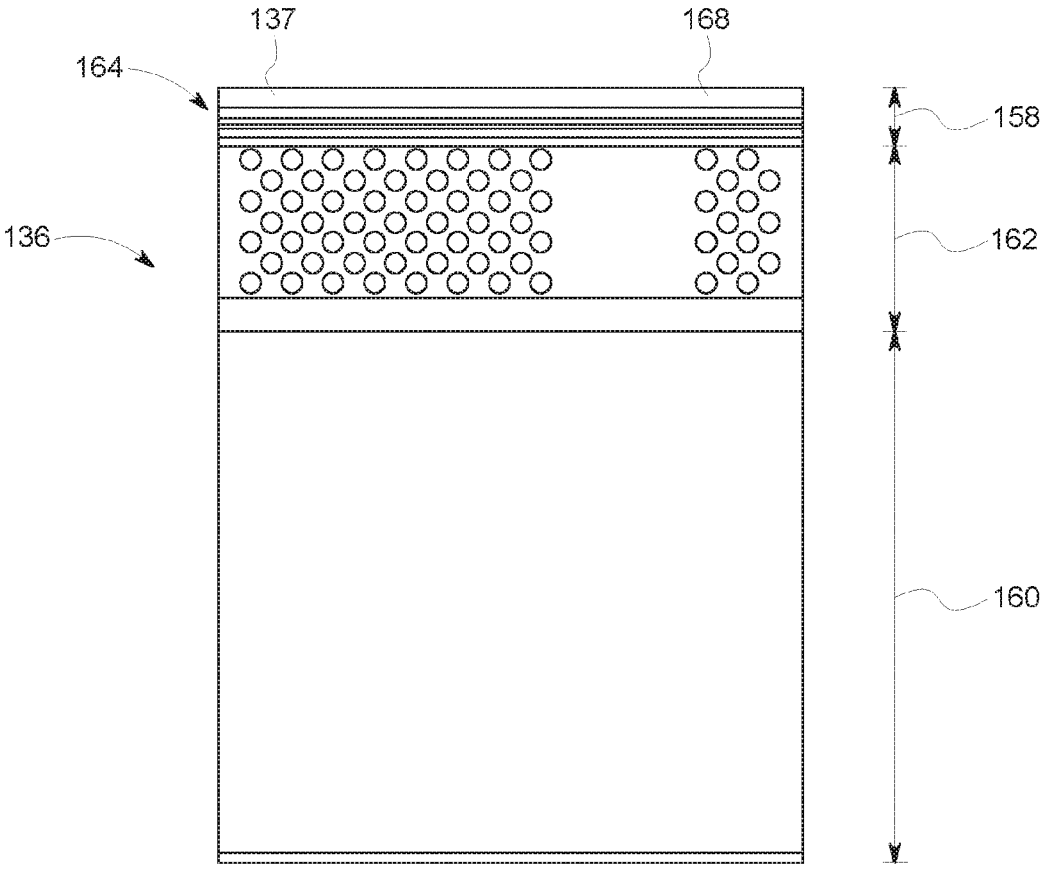
FIG. 9 is a front view of the removable shield shown in FIG. 8.

FIG. 7 is a perspective view of removable shield 136. FIG. 8 is a side view of removable shield 136. FIG. 9 is a front view of removable shield 136. Removable shield 136 includes an engagement portion 158, a deflection portion 160, and a perforated portion 162 extending between engagement portion 158 and deflection portion 160. Deflection portion 160 is angled in relation to perforated portion 162 such that deflection portion 160 and perforated portion 162 form an angle 163. During operation of circuit breaker 100, arc gas 140 contacts deflection portion 160 and is directed along deflection portion 160 away from line lugs 112 (shown in FIG. 3). A portion of arc gas 140 is directed towards perforated portion 162 and flows through openings in perforated portion 162 for exhausting from case 102 (shown in FIG. 1). Perforated portion 162 is positioned above line lugs 112 (shown in FIG. 3) such that arc gas 140 flows away from line lugs 112 and is inhibited from contacting line lugs 112. In alternative embodiments, circuit breaker 100 includes any removable shields 136 that enable circuit breaker 100 to operate as described herein.

In reference to FIGS. 3 and 8, engagement portion 158 of removable shield 136 includes engagement components 164 to engage top wall 128. Engagement components 164 include a plurality of ridges 166 and a lip 168. Ridges 166 deform as removable shield 136 is inserted through opening 138 and return to shape after passing through opening 138. As a result, engagement components 164 facilitate a snap-fit engagement between removable shield 136 and top wall 128 to inhibit displacement of removable shield 136 from opening 138. Lip 168 facilitates alignment of removable shield 136 in opening 138. In addition, lip 168 includes a tab 170 to facilitate removal of removable shield 136 from first end cover 124. To remove removable shield 136 from first end cover 124, a user applies force to a portion of removable shield 136, such as tab 170, until ridges 166 deform and allow release of engagement portion 158 from opening 138. Removable shield 136 is then pulled through opening 138 until removable shield 136 is free of first end cover 124. In alternative embodiments, removable shield 136 has any engagement portion 158 that enables removable shield 136 to function as described herein.

Figure 10:
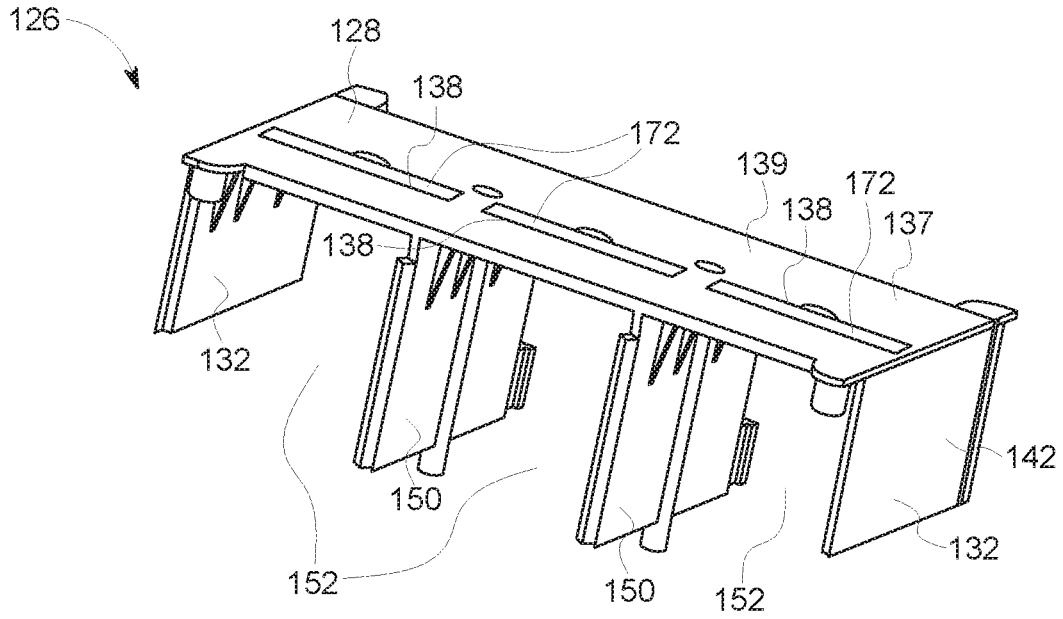
FIG. 10 is a perspective view of a portion of an end cover of the circuit breaker shown in FIG. 2.
Figure 11:
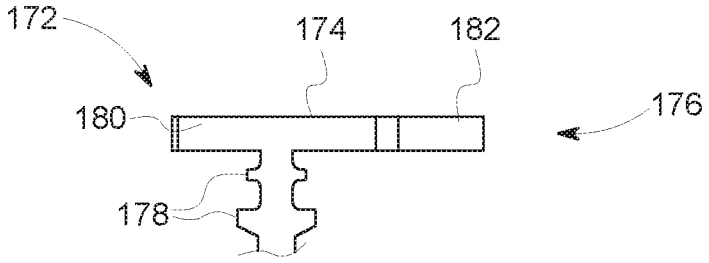
FIG. 11 is a side view of a plug of the end cover shown in FIG. 10.

FIG. 10 is a perspective view of upper portion 142 of second end cover 126. FIG. 11 is a side view of a plug 172 of second end cover 126. Upper portion 142 removably couples to lower portion 144 (shown in FIG. 3) and includes top wall 128 defining openings 138. Second end cover 126 further includes sidewalls 132 and partitions 150 at least partly defining slots 152 for receiving line lugs 112 and load lugs 114. In the illustrated embodiment, second end cover 126 is configured for coupling to second end 122 adjacent load lugs 114. Accordingly, removable shields 136 (shown in FIG. 3) are omitted since shielding of load lugs 114 is unnecessary. To inhibit access through openings 138, plugs 172 are installed in openings 138. In alternative embodiments, second end cover 126 is configured in any manner that enables circuit breaker 100 to operate as described herein. For example, in some embodiments, second end cover 126 is coupled to first end 120 of case 102. In further embodiments, at least one removable shield 136 (shown in FIG. 3) is coupled to second end cover 126.

In the exemplary embodiment, plugs 172 are positioned in openings 138 such that a top surface 174 of each plug 172 is substantially flush with top surface 139 of second end cover 126. Each plug 172 includes engagement components 176 that engage top wall 128 when plug 172 is inserted in opening 138. Engagement components 176 include a plurality of ridges 178 and a lip 180. Ridges 178 deform as plug 172 is inserted through opening 138 and return to shape after passing through opening 138. As a result, engagement components 176 facilitate a snap-fit engagement between plug 172 and top wall 128 to inhibit displacement of plug 172 from opening 138. Lip 180 facilitates alignment of removable shield 136 in opening 138. In addition, lip 180 includes a tab 182 to facilitate removal of plug 172 from second end cover 126. To remove plug 172 from second end cover 126, a user applies force to a portion of plug 172, such as tab 182, until ridges 178 deform and allow release of plug 172 from opening 138. In some embodiments, plugs 172 are positioned in at least one opening 138 of first end cover 124. In alternative embodiments, circuit breaker 100 includes any plugs 172 that enable circuit breaker 100 to operate as described herein.

Figure 12:
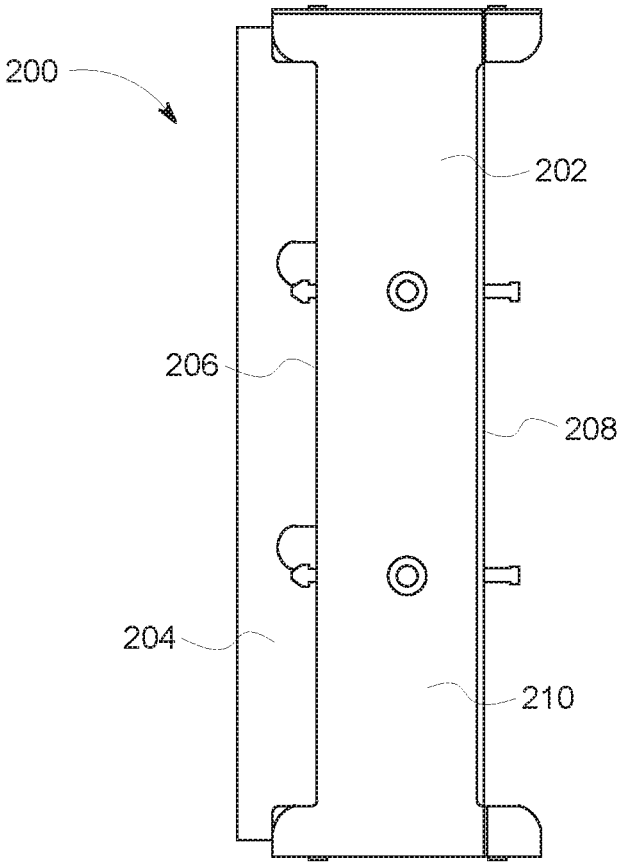
FIG. 12 is a top view of an alternative end cover for the circuit breaker shown in FIG. 1.
Figure 13:
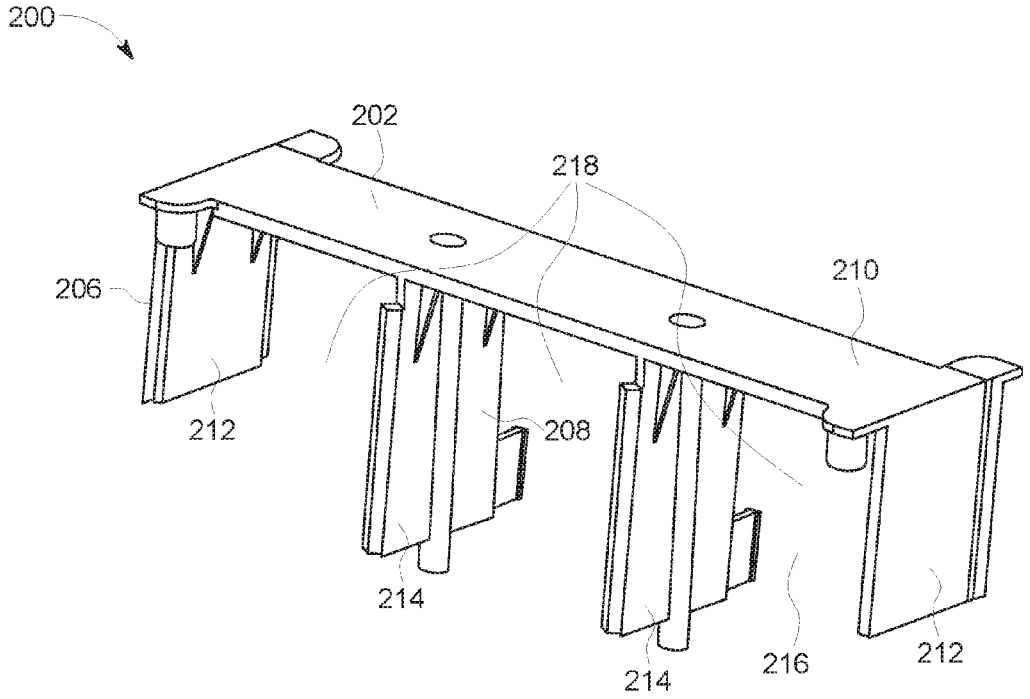
FIG. 13 is a perspective view of a portion of the end cover shown in FIG. 12.

FIG. 12 is a top view of an alternative end cover 200 for circuit breaker 100. FIG. 13 is a perspective view of an upper portion 202 of end cover 200. Upper portion 202 removably couples to a lower portion 204 to form end cover 200. End cover 200 is configured for use with circuit breaker 100 (shown in FIG. 1) when line lugs 112 (shown in FIG. 1) and/or load lugs 114 (shown in FIG. 1) are omitted. In other words, end cover 200 acts as a finishing end cover for use when at least one end of circuit breaker 100 (shown in FIG. 1) is coupled directly to a circuit without a lug. End cover 200 further includes a first end 206, a second end 208, a top wall 210, a pair of sidewalls 212, and a plurality of partitions 214. Top wall 210 and sidewalls 212 at least partially define an interior space 216. Partitions 214 divide interior space 216 into a plurality of slots 218. First end 206 couples to first end 120 (shown in FIG. 1) of case 102 (shown in FIG. 1) and second end 208 couples to second end 122 (shown in FIG. 1) of case 102 (shown in FIG. 1). Accordingly, end cover 200 is reversible such that different end covers 200 are not required for different ends of case 102 (shown in FIG. 1). In alternative embodiments, end cover 200 has any configuration that enables circuit breaker 100 to operate as described herein.

In reference to FIGS. 1, 2, 3, and 10, a method of manufacturing circuit breaker 100 includes positioning line lug 112 adjacent first end 120 of case 102. In some embodiments, load lug 114 is positioned adjacent second end 122 of case 102. The method further includes coupling first end cover 124 to first end 120 adjacent line lug 112. In some embodiments, second end cover 126 is coupled to second end 122 adjacent load lug 114. In further embodiments, removable shield 136 is coupled to first end cover 124 and plug 172 is positioned in opening 138 to close opening 138.

The circuit breakers described above generally include an electrically insulative case and end covers coupled to line and load ends of the case. The end covers are interchangeable to reduce the number of unique parts required to manufacture and assemble circuit breakers. A removable shield couples to the end cover coupled to the line end to shield line lugs from arc gas and particulates during operation of the circuit breakers. A plug couples to the end cover coupled to the load end to close an opening for receiving the removable shield. In some embodiments, a finishing end cover is coupled to an end of the case when lugs are omitted from the respective end of the circuit breaker.

An exemplary technical effect of the methods, systems, and apparatus described herein includes at least one of: (a) reducing cost to assemble circuit breakers; (b) providing interchangeable end covers for circuit breakers; (c) reducing the number of unique parts required for circuit breakers; and (d) increasing the lifecycle of lugs.

Exemplary embodiments of circuit breakers and methods of manufacturing circuit breakers are described above in detail. The circuit breakers and methods are not limited to the specific embodiments described herein but, rather, components of the circuit breakers and/or operations of the methods may be utilized independently and separately from other components and/or operations described herein. Further, the described components and/or operations may also be defined in, or used in combination with, other systems, methods, and/or devices, and are not limited to practice with only the circuit beakers and systems described herein.

The order of execution or performance of the operations in the embodiments of the disclosure illustrated and described herein is not essential, unless otherwise specified. That is, the operations may be performed in any order, unless otherwise specified, and embodiments of the disclosure may include additional or fewer operations than those disclosed herein. For example, it is contemplated that executing or performing a particular operation before, contemporaneously with, or after another operation is within the scope of aspects of the disclosure.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A circuit breaker arranged for selective current flow therethrough from a line end to an opposing load end, comprising:

an electrically insulative case comprising a line connection end, and a load connection end opposite said line connection end; and an end cover selectively installable on both said line connection end and load connection end of said electrically insulative case to cover a respective one of said line connection end and load connection end, said end cover comprising:

a wall defining at least one opening for receiving a removable shield;

a first end having a plurality of engagement components arranged to facilitate coupling of said first end to said electrically insulative case line connection end; and a second end having a plurality of engagement components arranged to facilitate coupling of said second end to said electrically insulative case load connection end.

2. The circuit breaker in accordance with claim 1, further comprising at least one plug disposed in the at least one opening to inhibit access therethrough.

3. The circuit breaker of claim 1, wherein said first end of said end cover further comprises a plurality of engagement components arranged to prevent coupling of said first end to said electrically insulative case load connection end.

4. The circuit breaker of claim 1, wherein said second end of said end cover further comprises a plurality of engagement components arranged to prevent coupling of said second end to said electrically insulative case line connection end.

5. The circuit breaker in accordance with claim 1 further comprising a set of line lugs extending from said electrically insulative case line connection end, said end cover coupleable to said electrically insulative case line connection end adjacent said set of line lugs, said wall further defining an interior space sized to receive said set of line lugs.

6. The circuit breaker in accordance with claim 5 wherein said end cover further comprises at least one partition defining a plurality of slots for said set of line lugs, said wall defining a plurality of openings for receiving a corresponding plurality of removable shields, each opening of the plurality of openings corresponding to one slot of the plurality of slots.

7. The circuit, breaker in accordance with claim 5, further comprising a set of load lugs and a second end cover, said set of load lugs extending from said electrically insulative case load end, said load end cover coupleable to said electrically insulative case load end adjacent said set of load lugs.

8. The circuit breaker in accordance with claim 7, wherein said circuit breaker further comprises a removable shield coupled to said first line end cover and extending adjacent said line lugs.

9. The circuit breaker in accordance with claim 8, wherein said load end cover comprises a wall defining at least one opening for receiving a removable shield, and wherein said circuit breaker further comprises a set of plugs closing the at least one opening.

10. The circuit breaker in accordance with claim 1, further comprising at least one removable shield coupled to said end cover.

11. The circuit breaker in accordance with claim 10, wherein said at least one removable shield comprises an engagement portion and a deflection portion.

12. The circuit breaker in accordance with claim 11, wherein said at least one removable shield further comprises a perforated portion extending between said engagement portion and said deflection portion.

13. An end cover for a circuit breaker having an electrically insulative case having a line end and a load end, said end cover comprising:

a first end having a plurality of engagement components arranged to facilitate selective coupling to said line end of said electrically insulative case;

a second end opposite said first end, having a plurality of engagement components arranged to facilitate selective coupling to said load end of the electrically insulative case; and a wall defining an interior space sized to receive at least one lug extending from the electrically insulative case;

wherein said end cover is selectively installable on one of said line end and said load end of said electrically insulative case to cover a respective one of said line end or said load end.

14. The end cover in accordance with claim 13, further comprising at least one removable shield coupled to said wall and extending through the interior space adjacent the at least one lug.

15. The end cover in accordance with claim 13, wherein said wall defines at least one opening sized to receive a removable shield, said end cover further comprising at least one plug disposed in the at least one opening to inhibit access therethrough.

16. The end cover in accordance with claim 13, further comprising at least one partition dividing the interior space into a plurality of slots sized to receive the at least one lug, said wall defining a plurality of openings sized to receive a corresponding plurality of removable shields, each opening of the plurality of openings corresponding to one slot of the plurality of slots.

17. The end cover in accordance with claim 13, further comprising an upper portion and a lower portion, said upper portion removably coupled to said lower portion.

18. The end cover in accordance with claim 13, wherein said wall is a top wall, and wherein said end cover further comprises a bottom wall opposite said top wall and a pair of sidewalls extending between said top wall and said bottom.

* * * * *